US009694220B2

(12) United States Patent
Gibbs

(10) Patent No.: US 9,694,220 B2
(45) Date of Patent: Jul. 4, 2017

(54) RESCUE STRAP

(71) Applicant: Shannon Gibbs, Canton, GA (US)

(72) Inventor: Shannon Gibbs, Canton, GA (US)

( * ) Notice: Subject to any disclaimer, the term of this patent is extended or adjusted under 35 U.S.C. 154(b) by 0 days.

(21) Appl. No.: 15/178,507

(22) Filed: Jun. 9, 2016

(65) Prior Publication Data

US 2016/0361576 A1 Dec. 15, 2016

Related U.S. Application Data

(60) Provisional application No. 62/173,166, filed on Jun. 9, 2015.

(51) Int. Cl.
*A62B 35/00* (2006.01)
*A61G 7/10* (2006.01)

(52) U.S. Cl.
CPC ..... *A62B 35/0025* (2013.01); *A61G 7/1023* (2013.01)

(58) Field of Classification Search
CPC ..... A62B 35/0006; A62B 35/0012; A62B 35/0018; A62B 35/0025; A62B 35/0031; A62B 35/0037; A61G 7/1023; A47D 13/025
USPC ..... 294/140, 149, 150, 152–157
See application file for complete search history.

(56) References Cited

U.S. PATENT DOCUMENTS 2,523,891 A * 9/1950 Wallstrom ..... A61G 7/10 294/140
4,553,633 A * 11/1985 Armstrong ..... A62B 35/0018 119/857
4,922,860 A * 5/1990 Hutchings ..... A01K 27/002 294/140
6,953,214 B2 * 10/2005 Paz ..... A45F 3/14 294/152
7,841,635 B2 * 11/2010 Fuchs ..... A45C 13/30 294/150
8,016,335 B2 * 9/2011 McKay ..... A62B 35/0006 294/141

* cited by examiner

*Primary Examiner* — Dean Kramer
(74) *Attorney, Agent, or Firm* — Incorporating Innovation LLC; Charlena Thorpe, Esq.

(57) ABSTRACT

Implementations of a rescue strap are provided. The rescue strap comprises a ring having extending therefrom a pull handle, a first strap; and a second strap. The pull handle comprises an elongated material having a first end and second end wherein the first end and the second end of the pull handle are secured about the ring such that the pull handle forms a loop with an opening therethrough for grabbing. The first strap comprises an elongated material having a first end and a second end and at least one grab loop extending from the first strap. A portion of the first strap is secured about the ring such that the first strap is secured to the ring and the first end and second end of the first strap extend from the ring. The second strap is similarly constructed.

18 Claims, 5 Drawing Sheets

RESCUE STRAP

CROSS REFERENCE TO RELATED APPLICATION

This application claims the benefit of U.S. Patent Application Ser. No. 62/173,166 which was filed on Jun. 9, 2015, and is incorporated herein by reference in its entirety.

TECHNICAL FIELD

This disclosure relates to implementations of a rescue strap.

BACKGROUND

Existing harnesses are time consuming to put on and can be too big or heavyweight. Furthermore, existing harnesses do not properly secure a person. Thus, a person can slip out of existing harnesses when lifted. Still further, existing harnesses do not have a mechanism specifically designed for dragging a persons or a mechanism specifically designed for picking up a person.

DETAILED DESCRIPTION

Implementations of a rescue strap are provided. In some implementations, the rescue strap comprises a ring having extending therefrom a pull handle, a first strap; and a second strap. In some implementations, the pull handle comprises an elongated material having a first end and second end wherein the first end and the second of the pull handle are secured about the ring such that the pull handle forms a loop with an opening therethrough for grabbing. In some implementations, the first strap comprises an elongated material having a first end and second end and at least one grab loop extending from the first strap. In some implementations, a portion of the first strap is secured about the ring such that the first strap is secured to the ring and the first end and second end of the first strap extend from the ring. In some implementations, the rescue strap is configured such that the first end and second end of the first strap are removably connected to form a closed first loop. In some implementations, the rescue strap is configured such that the size of the first loop formed by the first strap is adjustable. The second strap is similarly constructed.

Figure 1:
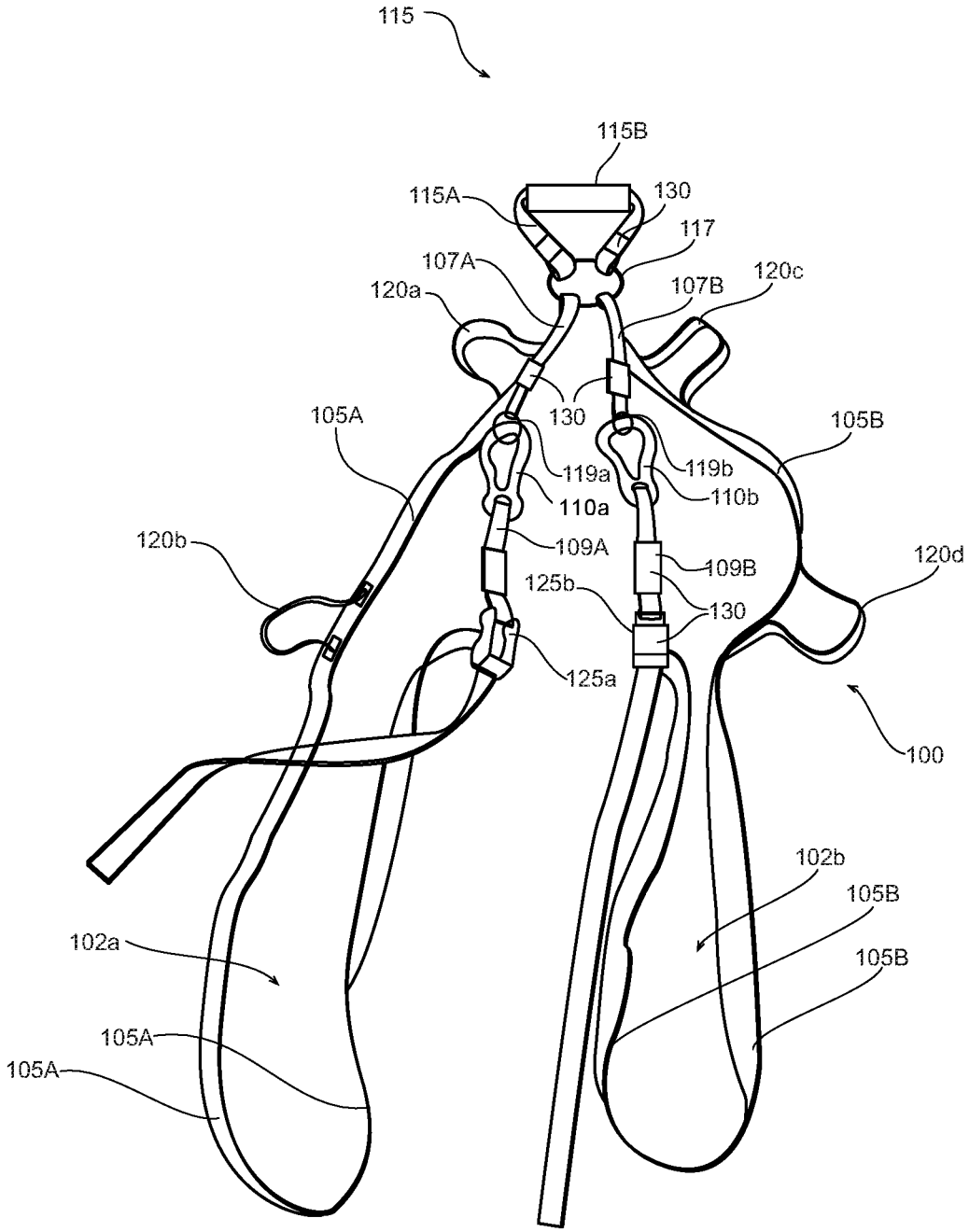
FIG. 1 illustrates an example rescue strap according to the present disclosure.

FIG. 1 illustrates an example rescue strap 100 according to the present disclosure. In some implementations, the rescue strap 100 may be used to extricate a person (e.g., an injured or unconscious person), for example, from a hazardous situation, by securing the rescue strap about their body and using a provided pull handle 115 or a combination of grab loops 120*a-d* (collectively 120) to move their body.

As shown in FIG. 1, in some implementations, the rescue strap 100 may comprise a ring 117 (e.g., D-ring) having attached thereto a pull handle 115 and two straps 105A, 105B.

Each strap 105A, B includes a pair of grab loops 120*a, b* and 120*c, d*, respectively, attached thereto.

In some implementations, the rescue strap 100 may further comprise buckles 125*a, b* (e.g., cam buckles) that are used to adjust the length of the straps 105A, B, respectively.

In some implementations, a first end of each strap 105A, B is fed through a first side of a buckle 125*a, b*, respectively, and a second end 107A, B of each strap 105A, B is removably connected to a second side of the buckle 125*a, b* to form a closed loop 102*a, b*, respectively.

In some implementations, the second end of 107A, B each strap is removably connected to the second side of the buckle 125*a, b* via a gathering ring 119*a, b*, respectively, secured to the second end 107A, B of the straps 105A, B and a strap extension 109A, B having a connector 110*a, b* (e.g., carabiner) secured on one end of the extension 109A, B with the opposing end of the strap extension 109A, B attached to the second side of the buckle 125A, B, where the connector 110*a, b* attaches to the gathering ring 119*a, b*, respectively.

In some implementations, the second end 107A, B of each strap 105A, B is removably connected to the second side of the buckle 125*a, b* by any suitable means presently known or future developed. A person of ordinary skill in the art would know other suitable means for removably connecting the second end of each strap 105A, B to the second side of the buckle 125*a, b* with the benefit of this disclosure.

In some implementations, the second end 107A, B of each strap 105A, B is intended to be permanently connected to the second side of the buckle 125*a, b* during normal use.

In some implementations, the pull handle 115 may be secured about the ring 117 by stitching the ends of the pull handle 115 around the ring 117. In this way a loop is formed.

In some implementations, the straps 105A, B may be secured about the ring 117 by stitching a portion of the straps around the ring 117. In some implementations, the straps 105A, B may be secured about the ring 117 by any suitable method. One of ordinary skill in the art with the benefit of this disclosure would know how to secure the straps 105A, B to a ring 117.

In some implementations, the pull handle 115 may comprise a strip of material 115A and a covering 115B over a portion of the strip of material 115A.

In some implementations, the strip of material 115A may be manufactured from flat nylon webbing. In some implementations, the strip of material 115A may be manufactured from any material suitable for use as part of a rescue strap, rescue harness, and/or rescue sling. In some implementations, the strip of material 115A may be fluorescent orange. In some implementations, the strip of material 115A may be any suitable color.

In some implementations, the covering 115B may be manufactured from plastic. In some implementations, the covering 115B may be manufactured from rubber. In some implementations, the covering 115B may be manufactured from any material stiff enough to prevent the loop formed through the attachment of the strip of material 115A to the ring 117 from collapsing about the user's hand during use. In some implementations, the covering 115B may be manufactured from any material stiff enough to maintain the loop formed by the material 115A. In some implementations, the covering 115B is tubular.

In some implementations, the ring 117 may be a D-ring. In some implementations, the ring 117 may be any ring or loop structure of any shape or any structure having an opening therethrough about which the straps 105A, B, and/or the pull handle 115 may be attached. In some implementations, the ring 117 may be manufactured from metal (e.g., steel, aluminum, and/or titanium). In some implementations, the ring 117 may be manufactured from high strength plastic. In some implementations, the ring 117 may be manufactured from any suitable material.

In some implementations, the straps 105A, B and the strap extensions 109A, B may be manufactured from tubular nylon webbing. In some implementations, the straps 105A, B and the strap extensions 109A, B may be manufactured from flat nylon webbing. In some implementations, the straps 105A, B and the strap extensions 109A, B may be manufactured from any material suitable for use as part of a rescue strap, rescue harness, and/or rescue sling.

In some implementations, the gathering rings 119*a, b* (collectively gathering rings 119) may be a D-ring. In some implementations, the gathering rings 119 may be any ring or loop structure of any shape or any structure having an opening therethrough about which the second end 107A, B of each strap 105A, B may be attached. In some implementations, the gathering rings 119 may be manufactured from metal (e.g., steel, aluminum, titanium). In some implementations, the gathering rings 119 may be manufactured from high strength plastic. In some implementations, the gathering rings 119 may be manufactured from any suitable material.

In some implementations, there may be more than two, or less than two (including zero), grab loops 120 located on each strap 105A, B of the rescue strap 100.

In some implementations, one grab loop 102*a, c* may be located adjacent the ring 117 as shown, for example, in FIG. 1.

In some implementations, a pair of grab loops (e.g., grab loops 102*a, b* and 102*c, d*) on a strap may be positioned so that a person can grab both loops with their hands simultaneously. For example, a pair of grab loops (e.g., grab loops 102*a, b* and 102*c, d*) on a strap may be located an average shoulder width apart. In some implementations, a pair of grab loops (e.g., grab loops 102*a, b* and 102*c, d*) on a strap may be located 18" to 24" apart. In some implementations, a pair of grab loops (e.g., grab loops 102*a, b* and 102*c, d*) on a strap may be closer or farther apart.

In some implementations, the grab loops 120 may be secured anywhere along the length of each strap 105A, B.

In some implementations, the grab loops 120 may be manufactured from tubular nylon webbing. In some implementations, the grab loops 120 may be manufactured from flat nylon webbing. In some implementations, the grab loops 120 may be manufactured from any material suitable for use as part of a rescue strap, rescue harness, and/or rescue sling. In some implementations, the grab loops 120 may be fluorescent orange. In some implementations, the grab loops 120 may be any suitable color.

In some implementations, the connector 110 may be any suitable device configured to removably secure to a ring or loop structure of any shape or any structure having an opening therethrough. In some implementations, the connector 110 may be a carabiner (see, e.g., FIG. 1). In some implementations, the connector 110 may be a carabiner as specified by the Occupational Safety and Health Administration. In some implementations, the connector may be manufactured from metal. In some implementations, the connector 110 may be manufactured from plastic. In some implementations, the connector 110 may be manufactured from any suitable material. One of ordinary skill in the art with the benefit of this disclosure would know how to properly select a connector for use as part of a rescue strap 100.

Figure 2A:
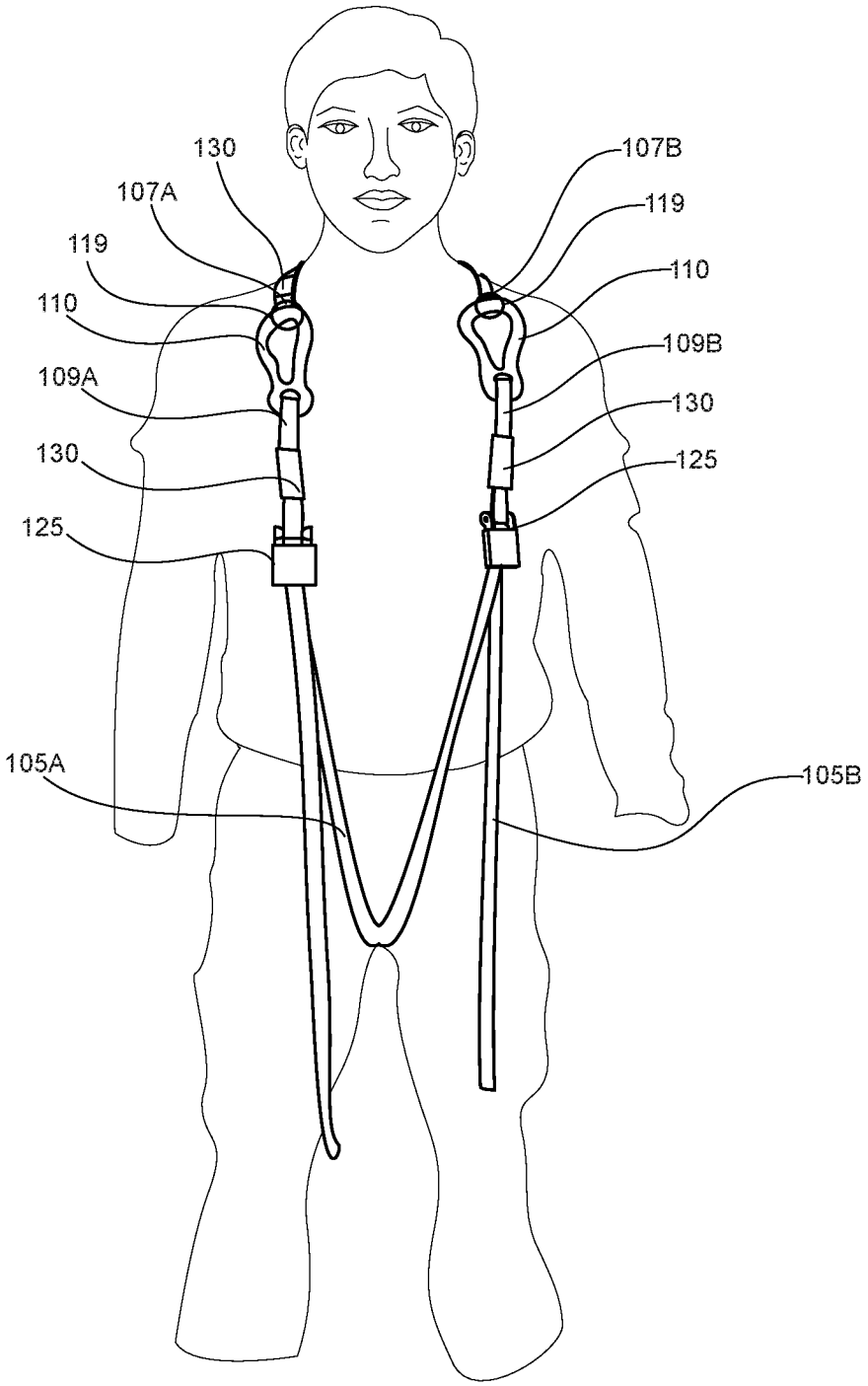
FIGS. 2A and 2B illustrate the example rescue strap of FIG. 1 secured to a person.
Figure 2B:
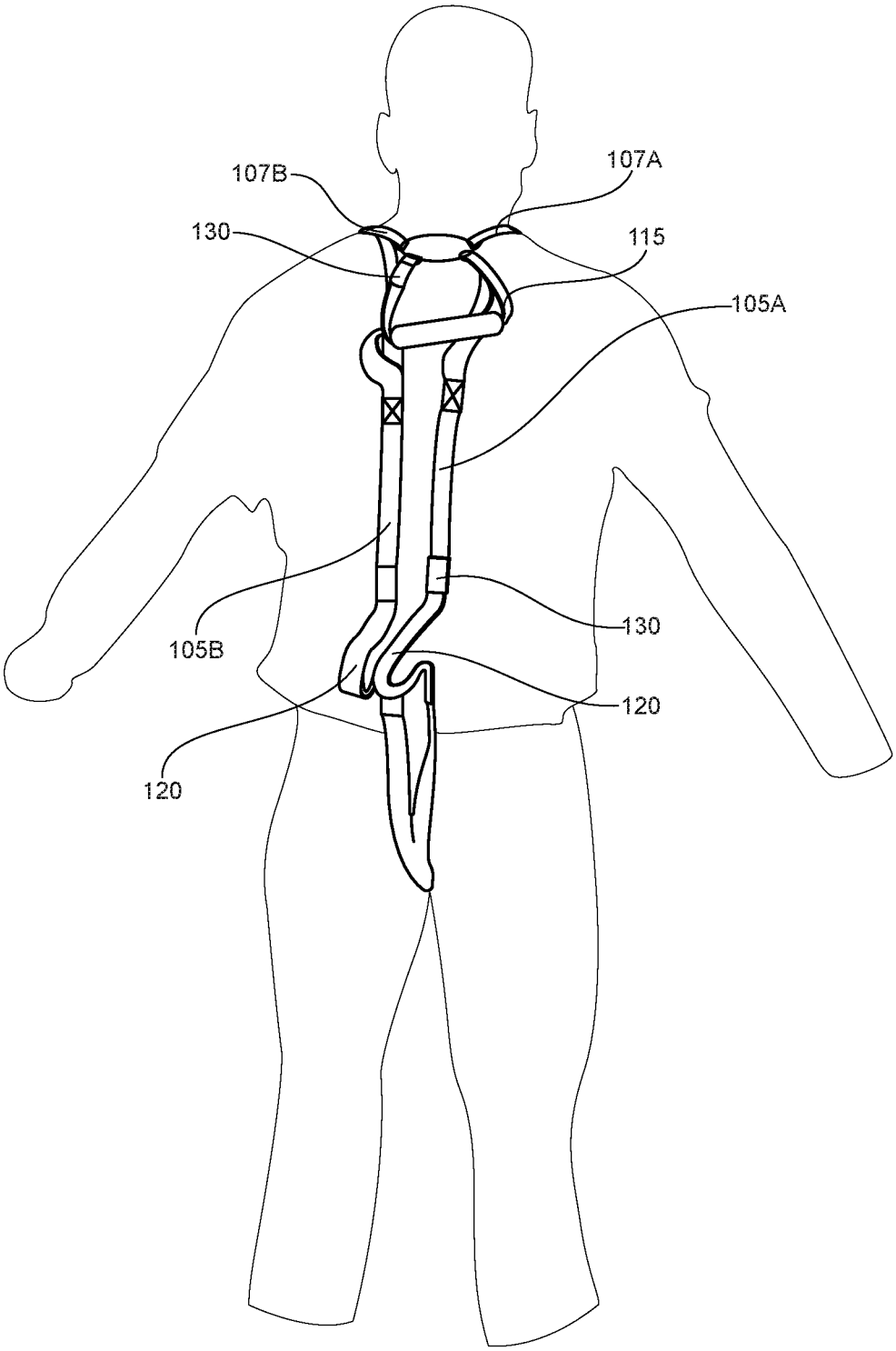

FIGS. 2A and 2B illustrate the rescue strap 100 secured to a person. In some implementations, the rescue strap 100 may be secured to a person (e.g., a fireman) as part of the person's equipment. In some implementations, the rescue strap 100 may be secured to an injured or unconscious person that may be lying down (see, e.g., FIG. 3).

Generally, to secure the strap 100 to a person, the second ends 107A, B of the straps 105A, B may be position about the right and left shoulder area, respectively, (see, e.g., FIG. 2A) with the straps 105 A, B extending down the back of the person (see, e.g., FIG. 2B), between the person's legs, and back up towards the right and left shoulder area (see, e.g. FIG. 2A). The first end and second of the straps 105A, B are then connected via the gathering rings 119*a, b* and connectors 110*a, b*, respectively, to form a closed loop 102*a*, 102*b*, respectively, about the person's torso. The buckle 125 can then be used to adjust the closed loop 102*a*, 102*b* to tighten the rescue strap 100 about the person.

Figure 3:
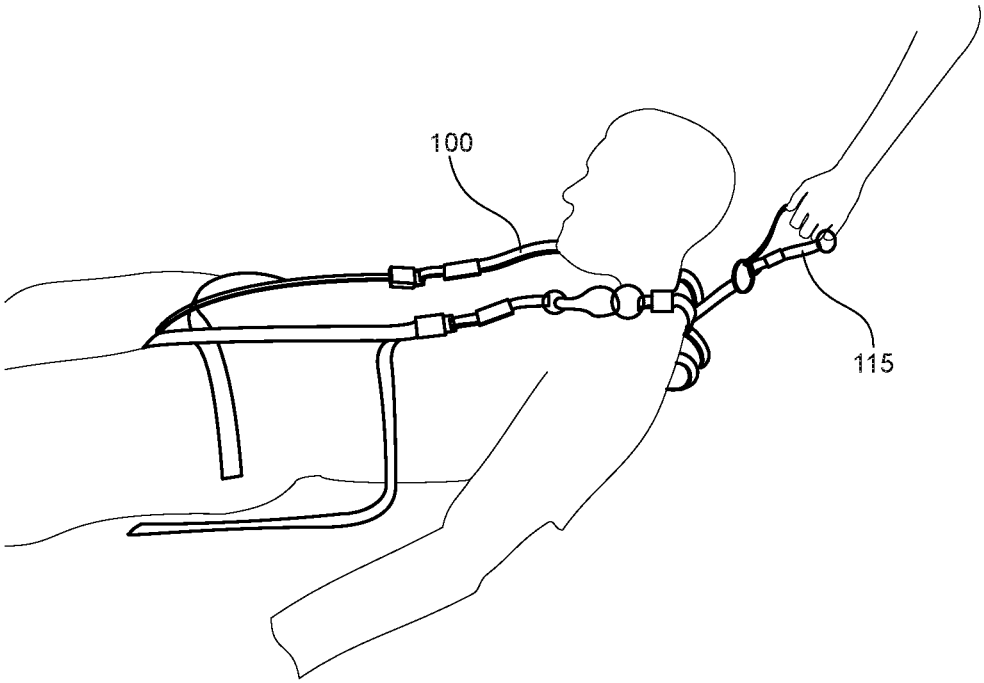
FIGS. 3 and 4 illustrate an example method of pulling a person using the example rescue strap of FIG. 1.

Once the rescue strap 100 is secured to a person, in some implementations, as shown in FIG. 3, the pull handle 115 of the rescue strap 100 may be used to move the person. In some implementations, to use the pull handle 115 to move the person, a rescuer may initially grab the pull handle 115, lift the injured person's torso off of the ground, and then drag the injured person to a desired location.

Figure 4:
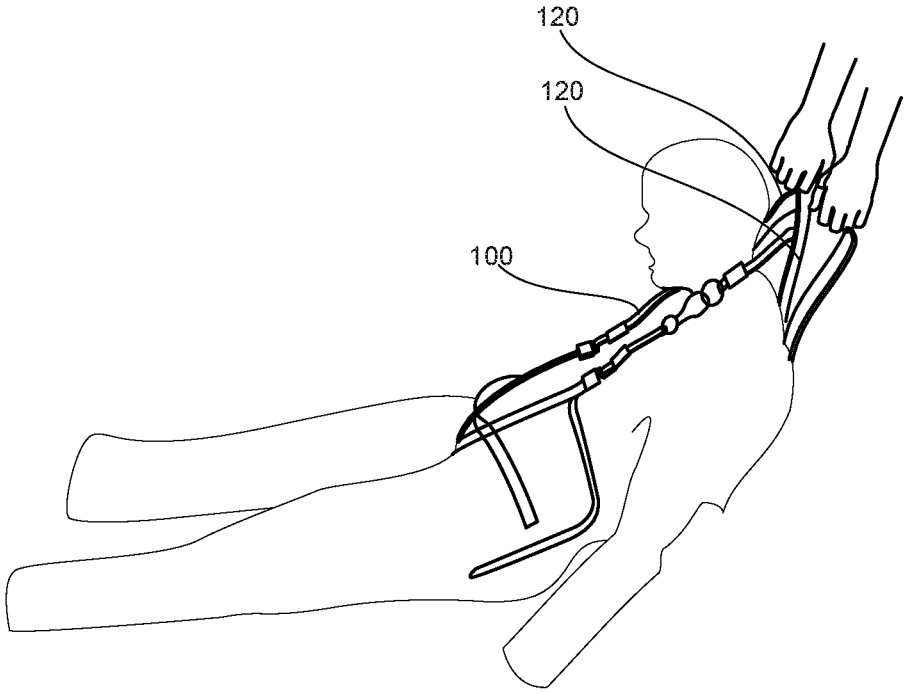

In some implementations, one or more of the grab loops 120 may be used to move the person. In some implementations, to use the grab loops 120, a single rescuer may grab one grab loop 120 on each strap 105A, B of the rescue strap 100, lift the person's torso off of the ground, and use the grab loops 120 to drag the person to a desired location (see, e.g., FIG. 4).

In some implementations, to use the grab loops 120, with two rescuers positioned on opposite sides of the person's body, each rescuer may then grasp two grab loops 120 located on the strap 105A or 105B closest to them. Using the grab loops 120, the rescuers may simultaneously lift the person off of the ground and carry them to a desired location.

As shown in FIGS. 1-2B, in some implementations, the rescue strap 100 may include a reflective portion 130. In some implementations, the reflective portion 130 may be used on any portion of the rescue strap 100 (e.g., the buckles 125, straps 105A, B, grab loops 120, and/or pull handle 115). In some implementations, the reflective portion 130 may be sewn onto a portion of the rescue strap 100. In some implementations, the reflective portion 130 may be secured to the rescue strap 100 through the use of an adhesive. In some implementations, the reflective portion 130 may be secured to the rescue strap 100 through any suitable method.

In some implementations, the reflective portion 130 may be a photoluminescent surface, a reflective surface, a retroreflective surface, or a combination thereof. In some implementations, the reflective portion 130 may reflect visible light, infrared light, or both. In some implementations, the reflective portion 130 may glow when heated. In some implementations, the reflective portion 130 may glow when exposed to visible light, infrared light, or both.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A rescue strap comprising:

a ring having extending therefrom a pull handle, a first strap; and a second strap, wherein, the pull handle comprises an elongated material having a first end and second end wherein the first end and the second end of the pull handle are secured about the ring such that the pull handle forms a loop with an opening therethrough for grabbing;

the first strap comprises an elongated material having a first end and second end and at least one grab loop extending from the first strap, wherein a portion of the first strap is secured about the ring such that the first strap is secured to the ring and the first end and second end of the first strap extend from the ring, wherein the rescue strap is configured such that the first end and second end of the first strap are removably connected to form a closed first loop, and wherein the rescue strap is configured such that the size of the first loop formed by the first strap is adjustable; and the second strap comprises an elongated material having a first end and second end and at least one grab loop extending from the second strap, wherein a portion of the second strap is secured about the ring such that the second strap is secured to the ring and the first end and second end of the second strap extend from the ring, wherein the rescue strap is configured such that the first end and second end of the second strap are removably connected to form a closed second loop, and wherein the rescue strap is configured such that the size of the second loop formed by the second strap is adjustable, wherein the at least one grab loop extending from the first strap comprises an elongated material having a first end and second end secured to the first strap thereby forming a loop with an opening therethrough for grabbing and the at least one grab loop extending from the second strap comprises an elongated material having a first end and second end secured to the second strap thereby forming a loop with an opening therethrough for grabbing.

2. The rescue strap of claim 1 wherein the pull handle, the at least one grab loop extending from the first strap, and the at least one grab loop extending from the second strap are fluorescent orange.

3. The rescue strap of claim 2 further comprising a tubular covering over a portion of the pull handle.

4. The rescue strap of claim 1 wherein the pull handle, the first strap, the second strap, the at least one grab loop extending from the first strap, and the at least one grab loop extending from the second strap are manufactured from nylon webbing.

5. The rescue strap of claim 1 wherein the first strap comprises two grab loops spaced apart and the second strap comprises two grab loops spaced apart.

6. The rescue strap of claim 1 further comprising a first buckle connected to the first strap to adjust the first loop and a second buckle connected to the second strap to adjust the second loop.

7. The rescue strap of claim 6 wherein the first end of the first strap extends through a first side of the first buckle and the second end of the first strap is removeably connected to the second side of the first buckle and wherein the first end of the second strap extends through a first side of the second buckle and the second end of the second strap is removeably connected to the second side of the second strap.

8. The rescue strap of claim 7 wherein the second end of the first strap is secured about a first ring and the second end of the second strap is secured about a second ring, the rescue strap further comprising a first connector extending from the second side of the first buckle and a second connector extending from the second side of the second buckle wherein the first connector and the second connector are configured to removably connect to the first ring and second ring, respectively.

9. The rescue strap of claim 6 further comprising a reflective portion on the first buckle and second buckle.

10. The rescue strap of claim 1 wherein the ring is a D-ring.

11. The rescue strap of claim 1 further comprising a reflective portion.

12. The rescue strap of claim 1 further comprising a reflective portion on the pull handle.

13. The rescue strap of claim 1 further comprising a reflective portion on the first and second strap.

14. The rescue strap of claim 1 further comprising a reflective portion on the grab loops.

15. The rescue strap of claim 1 further comprising a reflective portion on the first and second strap, the pull handle, and the grab loop.

16. A method of using a rescue strap comprising a ring having extending therefrom a pull handle, a first strap; and a second strap, wherein, the pull handle comprises an elongated material having a first end and second end wherein the first end and the second end of the pull handle are secured about the ring such that the pull handle forms a loop with an opening therethrough for grabbing; the first strap comprises an elongated material having a first end and second end and at least one grab loop extending from the first strap, wherein a portion of the first strap is secured about the ring such that the first strap is secured to the ring and the first end and second end of the first strap extend from the ring, wherein the rescue strap is configured such that the first end and second end of the first strap are removably connected to form a closed first loop, and wherein the rescue strap is configured such that the size of the first loop formed by the first strap is adjustable; and the second strap comprises an elongated material having a first end and second end and at least one grab loop extending from the second strap, wherein a portion of the second strap is secured about the ring such that the second strap is secured to the ring and the first end and second end of the second strap extend from the ring, wherein the rescue strap is configured such that the first end and second end of the second strap are removably connected to form a closed second loop, and wherein the rescue strap is configured such that the size of the second loop formed by the second strap is adjustable, wherein the at least one grab loop extending from the first strap comprises an elongated material having a first end and second end secured to the first strap thereby forming a loop with an opening therethrough for grabbing and the at least one grab loop extending from the second strap comprises an elongated material having a first end and second end secured to the second strap thereby forming a loop with an opening therethrough for grabbing, the method comprising securing the strap to a person by positioning the second ends of the first strap and second strap on the right and left shoulder area, respectively, of the person with a portion of the first strap and second strap extending down the back of the person, between the person's legs, and back up towards the right and left shoulder area, wherein the at least one grab loop extending from the first strap and second strap face away from the person's torso, and connecting the first end of the first strap to the second end of the first strap and the first end of the second strap to the second end of the second strap to form a first closed loop and second closed loop about the person's torso.

17. The method of claim 16 further comprising using the pull handle of the rescue strap to move the person by grabbing and pulling the pull handle.

18. The method of claim 16 further comprising using at least one of the at least one grab loop extending from the first strap and second strap to move the person by grabbing and pulling the grab loop.

* * * * *